US005561491A

United States Patent [19]

Rosenburgh et al.

[11] Patent Number: 5,561,491

[45] Date of Patent: Oct. 1, 1996

[54] VARIABLE LOOP ADDITIVE CONTROL FOR A PHOTOGRAPHIC PROCESSOR

[75] Inventors: John H. Rosenburgh, Hilton; David L. Patton, Webster; Ralph L. Piccinino, Jr., Rush, all of N.Y.

[73] Assignee: Eastman Kodak Company, Rochester, N.Y.

[21] Appl. No.: 438,288

[22] Filed: May 10, 1995

[51] Int. Cl.[6] ..... G03D 3/02

[52] U.S. Cl. ..... 396/626

[58] Field of Search ..... 354/332–324, 354/331, 336; 134/64 P, 64 R, 122 P, 122 R; 430/30, 398–400

[56] References Cited

U.S. PATENT DOCUMENTS

| | | | |
|---|---|---|---|
| 4,174,169 | 11/1979 | Melander et al. | 354/324 |
| 4,857,950 | 8/1989 | Takase et al. | 354/324 |
| 5,196,878 | 3/1993 | Muller et al. | 354/324 X |
| 5,237,360 | 8/1993 | Patton | 354/324 |
| 5,270,762 | 12/1993 | Rosenburgh et al. | 354/324 |
| 5,309,191 | 5/1994 | Bartell et al. | 354/299 |
| 5,347,336 | 9/1994 | Yamada et al. | 354/324 |
| 5,353,087 | 10/1994 | Rosenburgh et al. | 354/324 |
| 5,379,086 | 1/1995 | Kuzyk | 354/324 |

*Primary Examiner*—D Rutledge
*Attorney, Agent, or Firm*—C.J. Fildes & Co.

[57] ABSTRACT

A photographic processing apparatus including recirculation of processing solution is provided with a variable loop additive control system comprising a treatment container in which additive solids, pastes or fluids are introduced and through which a controlled volume of processing solution is circulated from and back to the recirculating system loop. The secondary loop of the additive system allows control of the flow of processing solution through the treatment container so that the mixing of the additive into the processing solution may be controlled at a desired rate and the additive is not excessively utilized or dissipated. Various arrangements for connecting a secondary additive loop to the primary loop of a recirculating processing solution system are illustrated.

15 Claims, 7 Drawing Sheets

VARIABLE LOOP ADDITIVE CONTROL FOR A PHOTOGRAPHIC PROCESSOR

FIELD OF THE INVENTION

This invention relates to photographic processing and particularly to processing apparatus including means for altering or stabilizing a recirculating processing solution.

BACKGROUND OF THE INVENTION

It is known in the art to provide photographic material processors having a processing solution which is recirculated by a recirculation pump from a processing tank through a replenishment manifold, a filter and a heater. Conventional standard metering bellows pumps are used to add replenishing solution to the manifold for mixing with the recirculating solution. In recent low volume processors, replenishment may be added directly into a closed recirculation system and introduced either into the negative or positive pressure side of the recirculation pump.

If an additional component, such as a solid, paste or liquid chemical additive is to be used to alter or stabilize the chemical consistency, there is no specific provision to control the rate of exposure of the additional component to the recirculating solution in either the closed or open recirculation systems.

SUMMARY OF THE INVENTION

The present invention provides processing apparatus for introducing an additional chemical altering component to a photographic material processor while controlling the rate at which the processing solution contacts the additional material. By controlling the rate of solution exposure, the rate at which the additional material is added to (or used to remove contaminates from) the processing solution can be controlled to maximize chemical and additive efficiency.

For example if an ion exchange resin was used to remove contaminates from the stabilizer section of the processor, full recirculation flow over the resin would remove the contaminate to an undesirable level and also exhaust the ion exchange resin too quickly. By controlling the flow rate in a secondary loop, the agitation in the photographic processor is unaffected and the exposure of the ion exchange resin can be optimized. This is also true of other additives where the introduction rate or the dissolving rate of a solid needs to be controlled independent of the processor's recirculation rate.

This secondary loop can be in an addition to an existing replenishment and recirculation system. Alternatively, it could be used solely for control and introduction of liquid, paste or solid dissolving, or ion exchange type replenishment components or premixes.

These and other features and advantages of the invention will be more fully understood from the following detailed description of the invention taken together with the accompanying drawings.

DETAILED DESCRIPTION OF THE INVENTION

Figure 1:
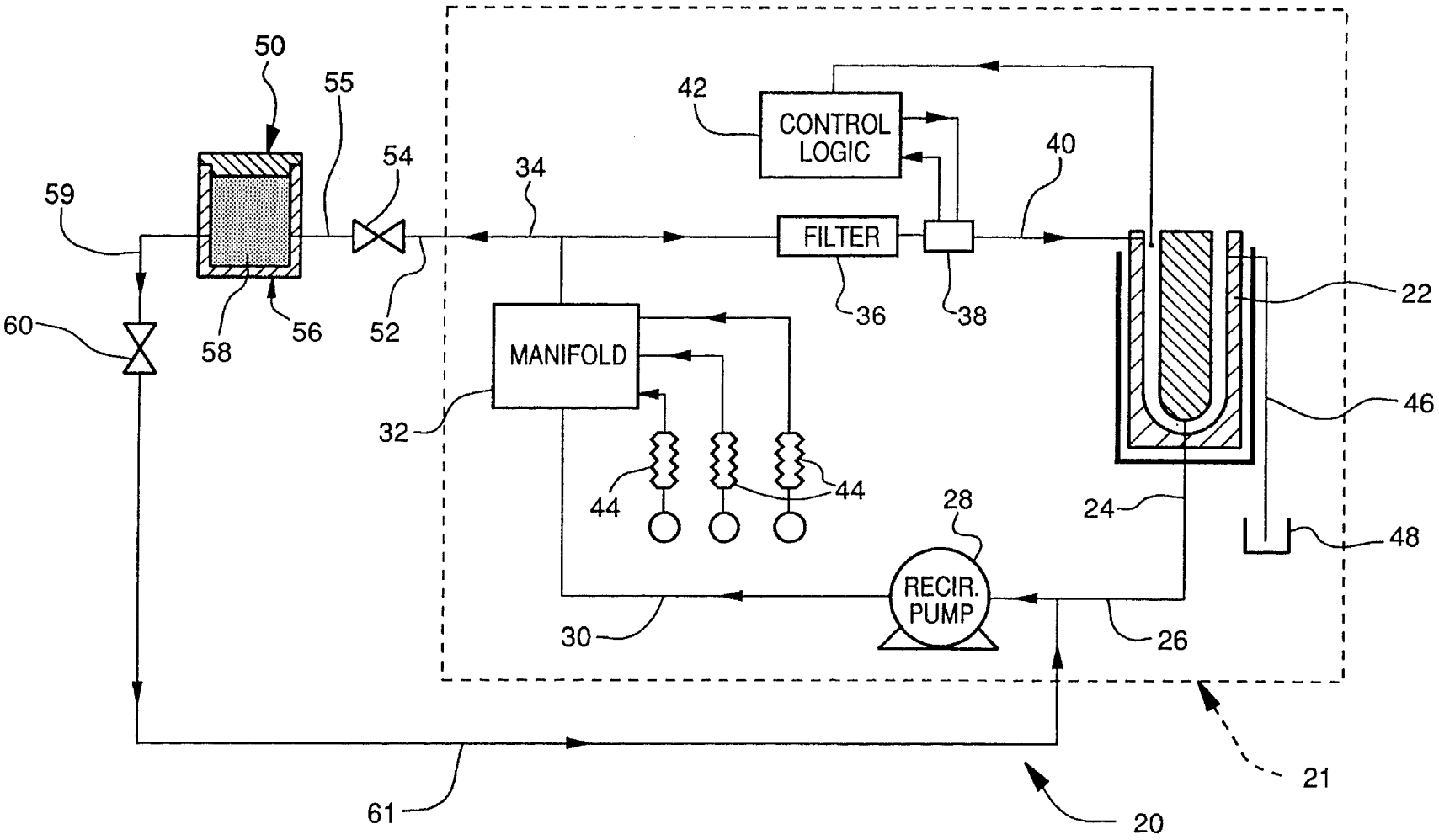
FIG. 1 is a schematic view of a known recirculation and replenishment system modified to form a first embodiment of closed variable loop additive system according to the invention.

Referring first to FIG. 1 of the drawings, there is shown a photographic processing apparatus generally indicated by numeral 20. Apparatus 20 is based, for example, upon a prior apparatus 21, the features of which are described in U.S. Pat. No. 5,270,762 issued Dec. 14, 1993. This prior apparatus 21 defines a primary loop that includes a processing tank 22 from which processing solution is drawn from an outlet 24 through conduit 26 by a recirculating pump 28. The pump recirculates the solution via conduit 30 through manifold 32, conduit 34 filter 36 and heat exchanger 38, from which it is returned to the tank 22 by way of conduit 40.

An electronic control 42 is connected to sense and control the temperature of processing solution recirculated to the tank 22 from the heat exchanger 38. Standard metering bellows pumps 44 are provided to replenish the used solution by pumping controlled amounts of additive chemicals into the manifold 32 for mixing with the recirculating solution. An overflow drain 46 conducts excess solution from the processing tank 22 to an overflow reservoir 48.

In accordance with the invention, the embodiment of FIG. 1 additionally includes a secondary loop defining a first embodiment of closed variable loop additive system generally indicated by numeral 50. System 50 includes a conduit 52 which draws fluid from conduit 34 of the recirculating system from which it is conducted through a regulating valve 54 and conduit 55 to a closed pressurized treatment container generally indicated by numeral 56.

Within the container 56, some form of solid, paste or liquid treatment substance 58 is provided which mixes, dissolves into or reacts with the processing solution passing through the container 56 for the purpose of treating the processing solution to extend its life or to remove contaminates therefrom. The treated solution is conducted from the container 56 through conduit 59, shutoff valve 60 and conduit 61 by which it is returned to conduit 26 on the suction side of the recirculation pump 28.

In this embodiment 50 of the additive system, circulation of the fluid through the secondary loop is provided by the pressure drop from the pressurized portion of the recirculating system in conduit 34 to the lower pressure or negative pressure portion of the recirculating system in conduit 26 on the suction side of the recirculating pump. Control of flow through the additive system is provided by the regulating valve 54 which may be adjusted as desired to control the rate of solution flow through the treatment container 56 so as to add only the desired amount of treatment chemicals 58 to the solution, thus controlling the rate of use of the treatment additives and maintaining the recirculating solution in the desired condition with a minimum use of the additives.

Figure 2:
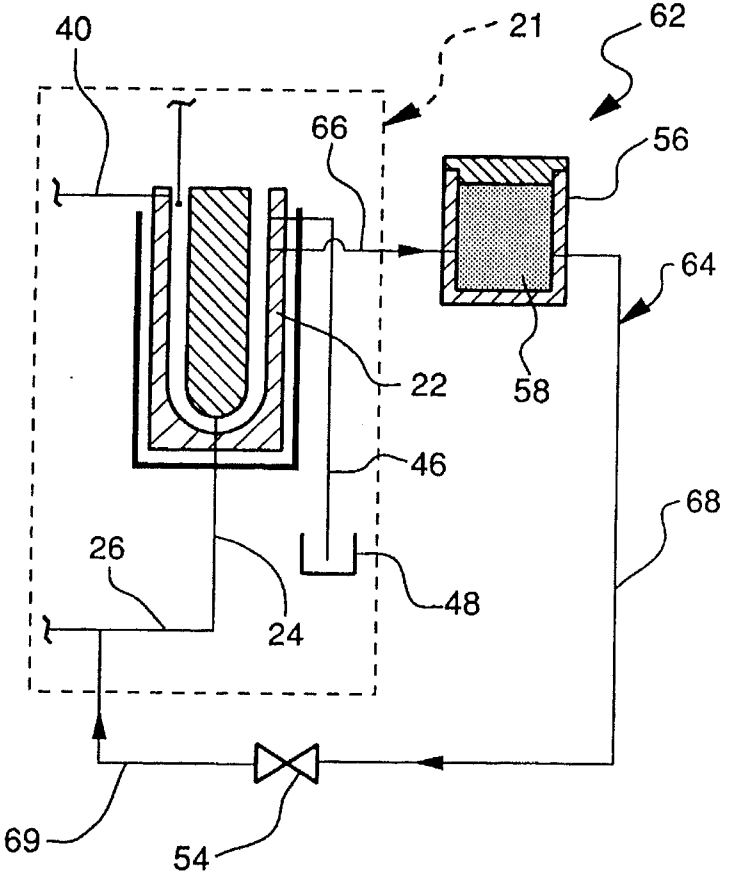
FIG. 2 is a fragmentary view similar to FIG. 1 but showing a closed variable loop negative pressure additive system according to the invention.

FIG. 2 illustrates a second embodiment 62 of the invention including the prior art processing apparatus 21 of FIG. 1 and wherein like numerals are used for like parts. This embodiment of FIG. 2 includes a secondary loop defining another closed variable loop additive system 64 which differs in that processing solution is conducted directly from the tank 22 through a conduit 66 to the pressurized treatment container 56 containing at least one additive treatment substance 58. From this container, treated solution is conducted through a conduit 68, regulating valve 54 and conduit 69 to conduit 26 at the inlet or suction side of the recirculating pump 28. In this case also, flow through the secondary loop is caused by the pressure drop between the processing tank and the inlet of the recirculating pump between which the loop is connected. As before, control of flow through the secondary loop is by means of the regulating valve 54.

Figure 3:
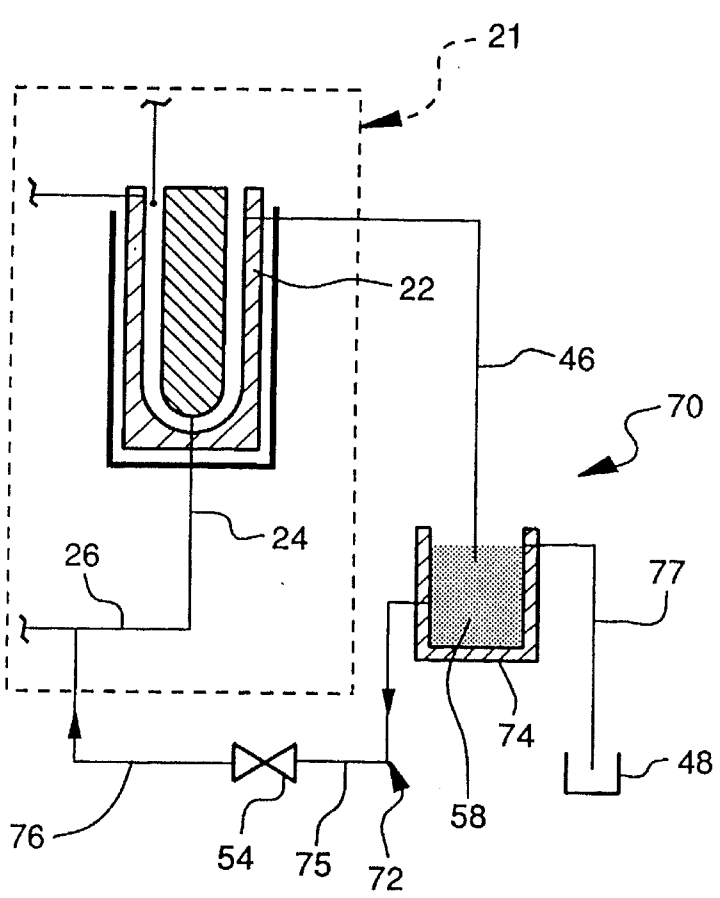
FIG. 3 is a fragmentary view similar to FIG. 2 but showing an open variable loop additive system.

FIG. 3 shows a third embodiment 70 of the invention, again including the prior apparatus 21 shown in FIG. 1 and wherein like numerals indicate like parts. This third embodiment differs in that the secondary loop defines an open additive system 72 wherein the overflow drain 46 of the reservoir empties into the treatment container 74 which is of the open unpressurized type and contains an additive treatment substance 58. Treated solution is carried through conduit 75, regulating valve 54 and conduit 76 to the inlet, or suction, side of the recirculating pump 28 and conduit 26. Any overflow from the container 74 is passed through a drain conduit 77 to an overflow reservoir 48.

Figure 4:
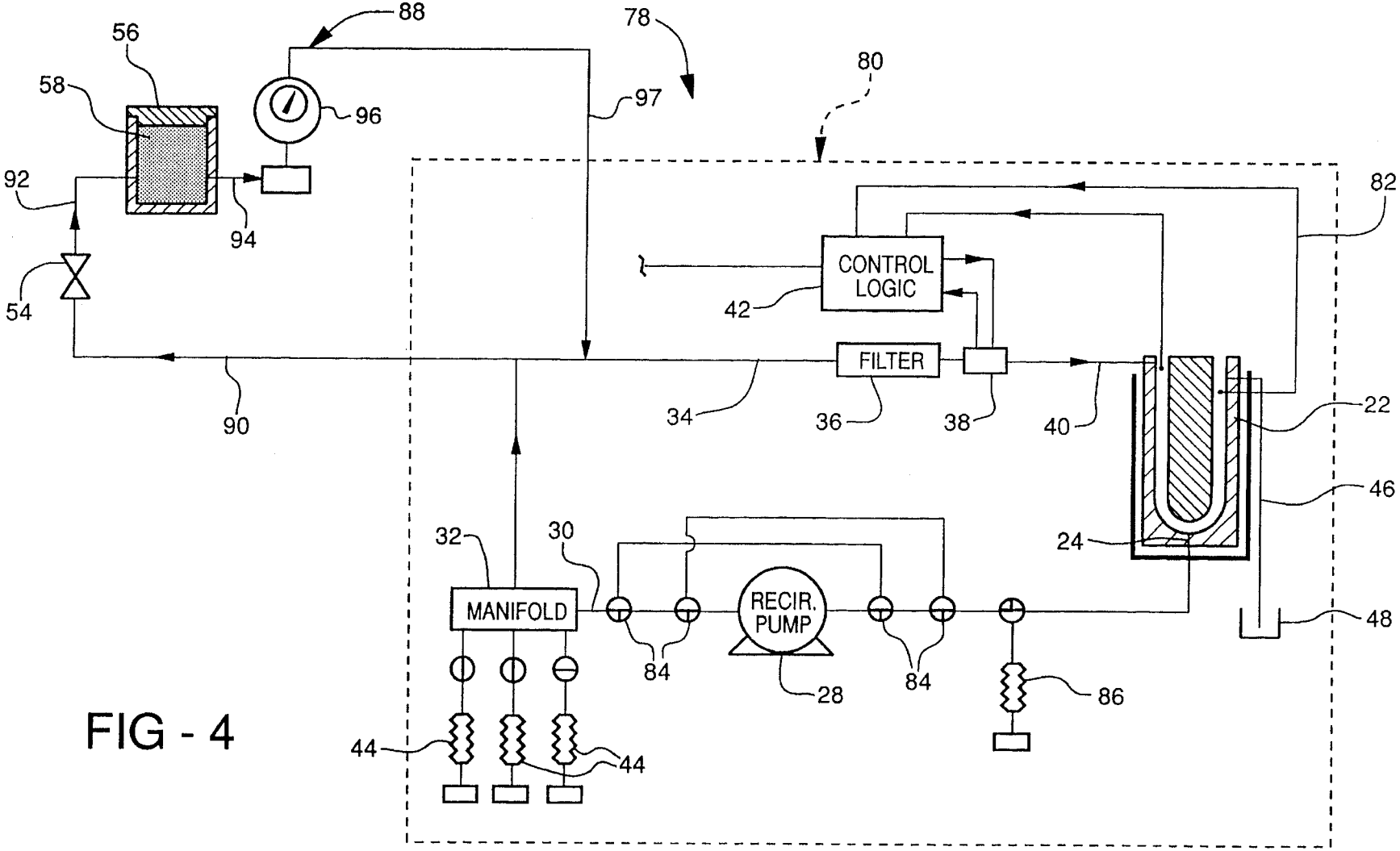
FIG. 4 is a schematic diagram of another recirculation and replenishment system modified to show a pump circulated closed variable loop additive system according to the invention.

Referring to FIG. 4, a fourth embodiment 78 of the invention is shown based on a prior processing apparatus, 80 as shown in U.S. Pat. No. 5,309,191 issued May 3, 1994. The prior apparatus 80 defines a primary loop and is similar to that previously described with respect to FIG. 1 so that like numerals are used for like parts. It differs in the addition of an overflow sensor 82 connected to the electronic control 42, backflush valves 84 connected around the recirculating pump 28 and a filling pump 86 connected near the recirculating pump inlet. None of these differences have any significant effect upon features of the present invention.

A closed variable loop additive system 88 is included which defines a secondary loop that receives processing solution from and returns it to the recirculating system in conduit 34 between the manifold 32 and filter 36. System 88 draws solution through conduit 90, regulating valve 54 and conduit 92 into the pressurized treatment container 56 holding treatment substance 58. The treated solution flows from container 56 through conduit 94 to a metering pump 96 which circulates the solution back through conduit 97 to the recirculating system in conduit 34. In this embodiment, there is no significant pressure differential between the inlet and outlet of the secondary loop. Therefore, flow through the loop of system 88 is controlled entirely by the metering pump 96 which creates the flow and regulating valve 54 which may limit or control the flow.

Figure 5:
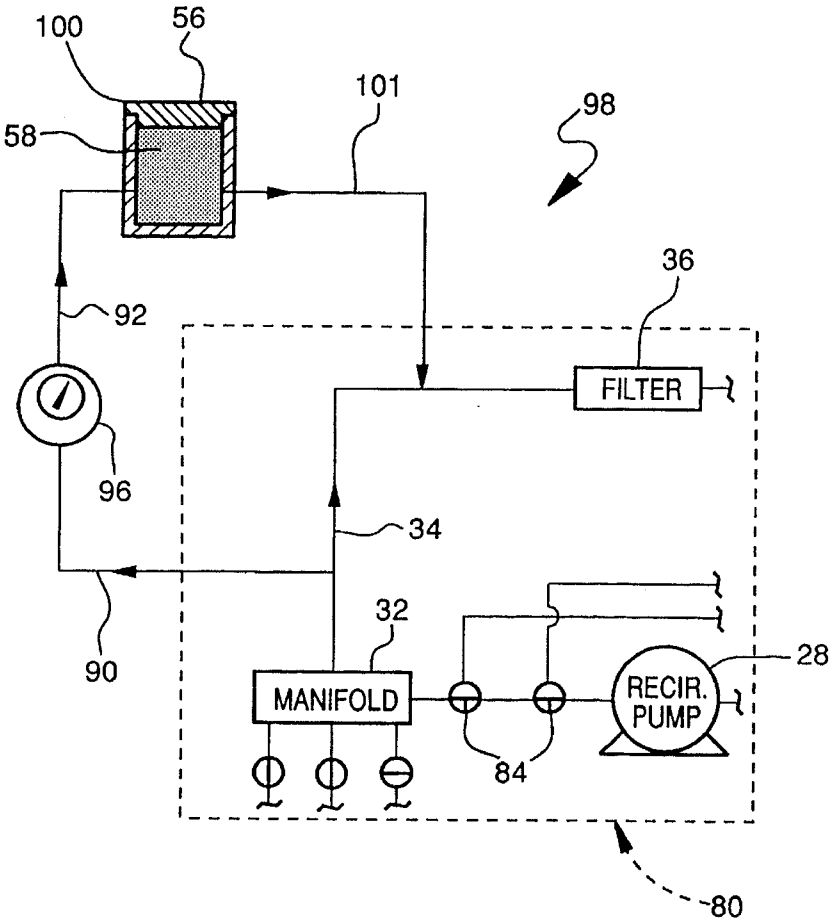
FIG. 5 is a fragmentary view similar to FIG. 4 but showing an alternative pumped closed variable loop additive system.

FIG. 5 illustrates a fifth embodiment 98 of the invention which is similar to that shown in FIG. 4 with the exception that the secondary loop additive system 100 has no control valve 54 and metering pump 96 is moved to the location of the previous control valve between conduits 90 and 92 on the inlet side of the pressurized treatment container 56. In this fifth embodiment, flow through the additive system secondary loop including conduit 90, pump 96, conduit 92, closed container 58 and conduit 101 is controlled entirely by the metering pump 96.

Figure 6:
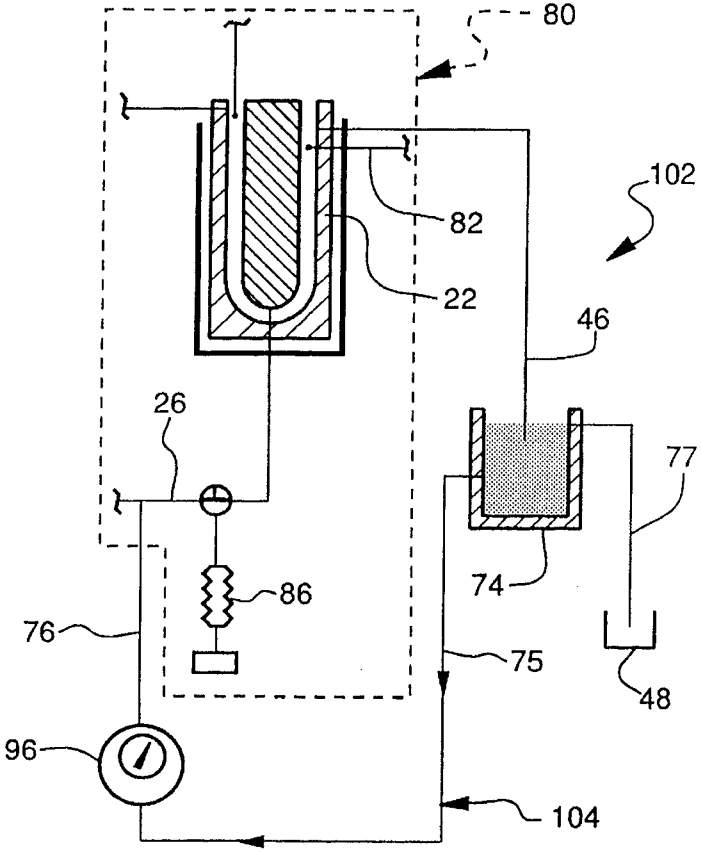
FIG. 6 is a fragmentary view similar to FIG. 5 showing a pumped variable open loop additive system.

In FIG. 6 there is shown a sixth embodiment 102 of the invention connected to a prior apparatus 80 as described relative to FIG. 4. The additive system 104 of the invention is similar to that shown in FIG. 3 in that tank overflow through overflow drain 46 is delivered to an open treatment container 74 containing a treatment substance 58 and the treated solution is returned through conduit 75 via a metering pump 96 which pumps the treated solution back through conduit 76 into the recirculating system at conduit 26 on the inlet side of the recirculating pump 28. Here, flow through the additive system 104 is controlled by the metering pump 96 instead of the valve 54 as in of the FIG. 3 embodiment. In this embodiment also, drain flow from the treatment tank 74 passes through drain conduit 77 to the overflow reservoir 48.

Figure 7:
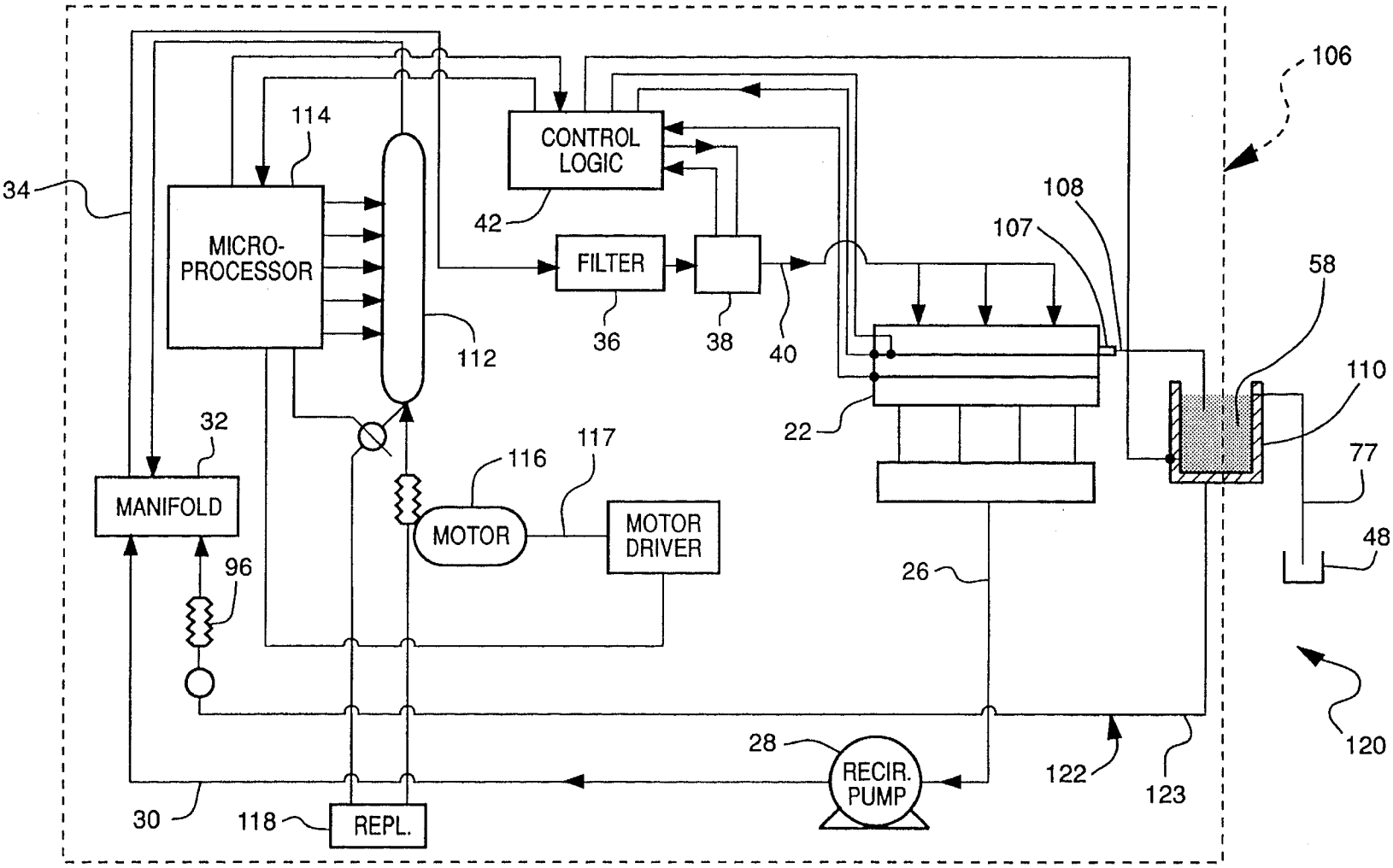
FIG. 7 is a schematic diagram showing yet another recirculation and replenishment system including a pumped variable open loop additive system according to the invention.
Figure 9:
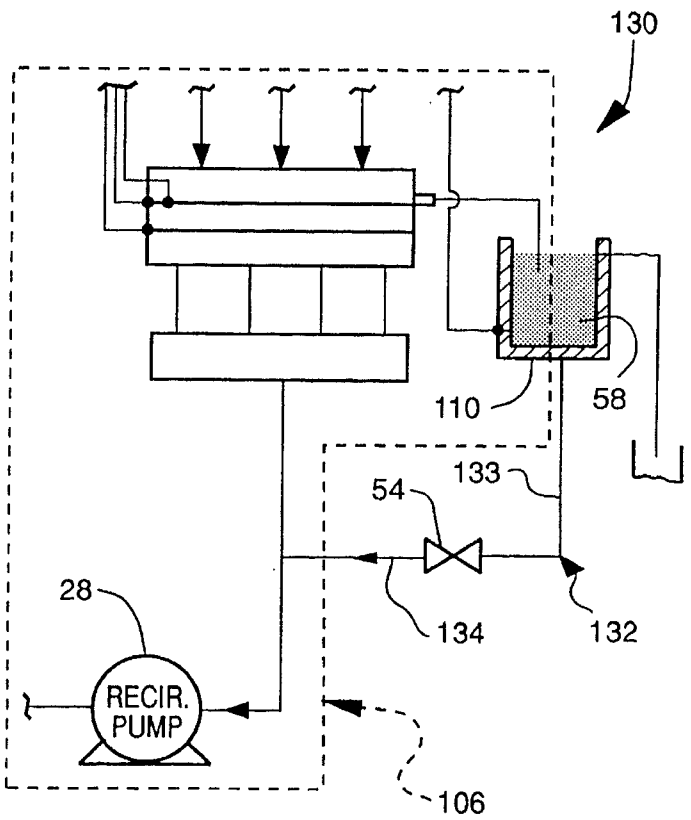
FIG. 9 is a fragmentary view similar to FIG. 8 showing another embodiment of open variable loop additive system.
Figure 8:
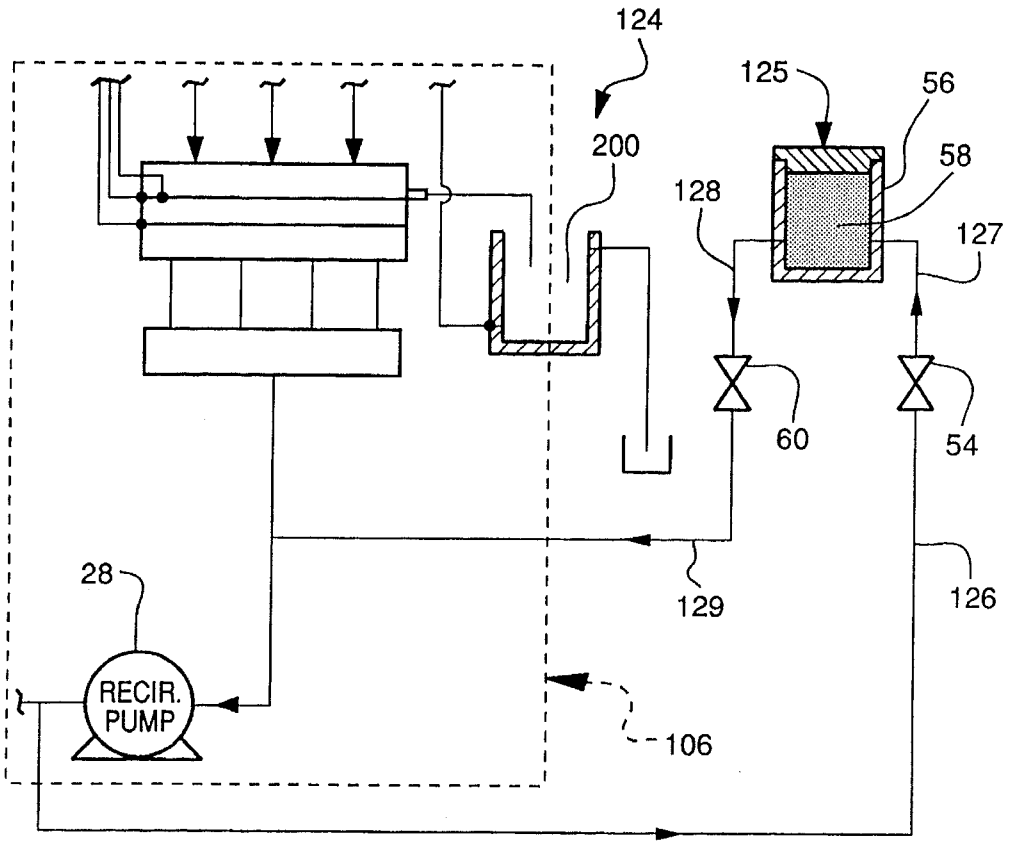
FIG. 8 is a fragmentary view similar to FIG. 7 but showing a closed variable loop additive system.

FIGS. 7–9 show additional embodiments of secondary loop additive systems according to the invention which are connected with a third prior photographic processing apparatus 106 defining a primary loop and described in U.S. Pat. No. 5,353,087 issued Oct. 4, 1994. Since this apparatus 106 bears basic similarities to apparatus 21 and 80 previously described, like numerals are used for like or similar parts. Module 22, which has a processing function as does the processing tank of FIGS. 1–6, has an overflow drain 107 that connects through a conduit 108 with a container 110 carrying treatment additives 58. This container 110 is used as the treatment container in the embodiments of FIGS. 7–9. Overflow from the treatment container 110 passes through an overflow drain 77 to the overflow reservoir 48. Other features of the processing system that have no significant bearing on the present invention include a metering vessel 112 in which fluid level is sensed by a microprocessor 114 controlled by the electronic control 42 to actuate a motor 116 driving a metering pump 117 to provide replenishing solution from a tank 118 for entry into the manifold 34 of the recirculating system.

In the present invention, FIG. 7 illustrates a seventh embodiment 120 including an additive system 122 wherein treated solution, created by adding treatment solids, paste or liquid to the treatment container 110, is drawn through a conduit 123 by a metering pump 96 and forced into the manifold 32 for mixing with the recirculating solution in the primary loop. In this embodiment, flow of the treated solution from the container 110 is controlled entirely by the metering pump 96.

FIG. 8 discloses an eighth embodiment 124 having a secondary loop additive system 125 wherein process solution is taken from the pressure side of the recirculating pump 28 through conduit 126, regulating valve 54 and conduit 127 to a separate pressurized treatment container 56 holding a treatment substance 58. Treated solution is drawn from container 56 through conduit 128, shutoff valve 60 and conduit 129 to the inlet side of the recirculating pump 28. Flow through the additive system 125 is caused by the pressure drop from the outlet to the inlet side of the recirculating pump 28 and is controlled entirely by the regulating valve 54 in the secondary loop.

FIG. 9 describes a ninth embodiment 130 of the invention including a secondary loop additive system 132 wherein treated solution is drawn from the container 110, having treatment additives 58, through a conduit 133, regulating valve 54 and conduit 134 to the inlet side of the recirculating pump 28. In this embodiment, flow is caused by the pressure drop between the atmospheric pressure in container 110 and its connection to the negative pressure on the inlet side of the recirculating pump 28 and the flow is controlled by the regulating valve 54.

Figures 10, 11:
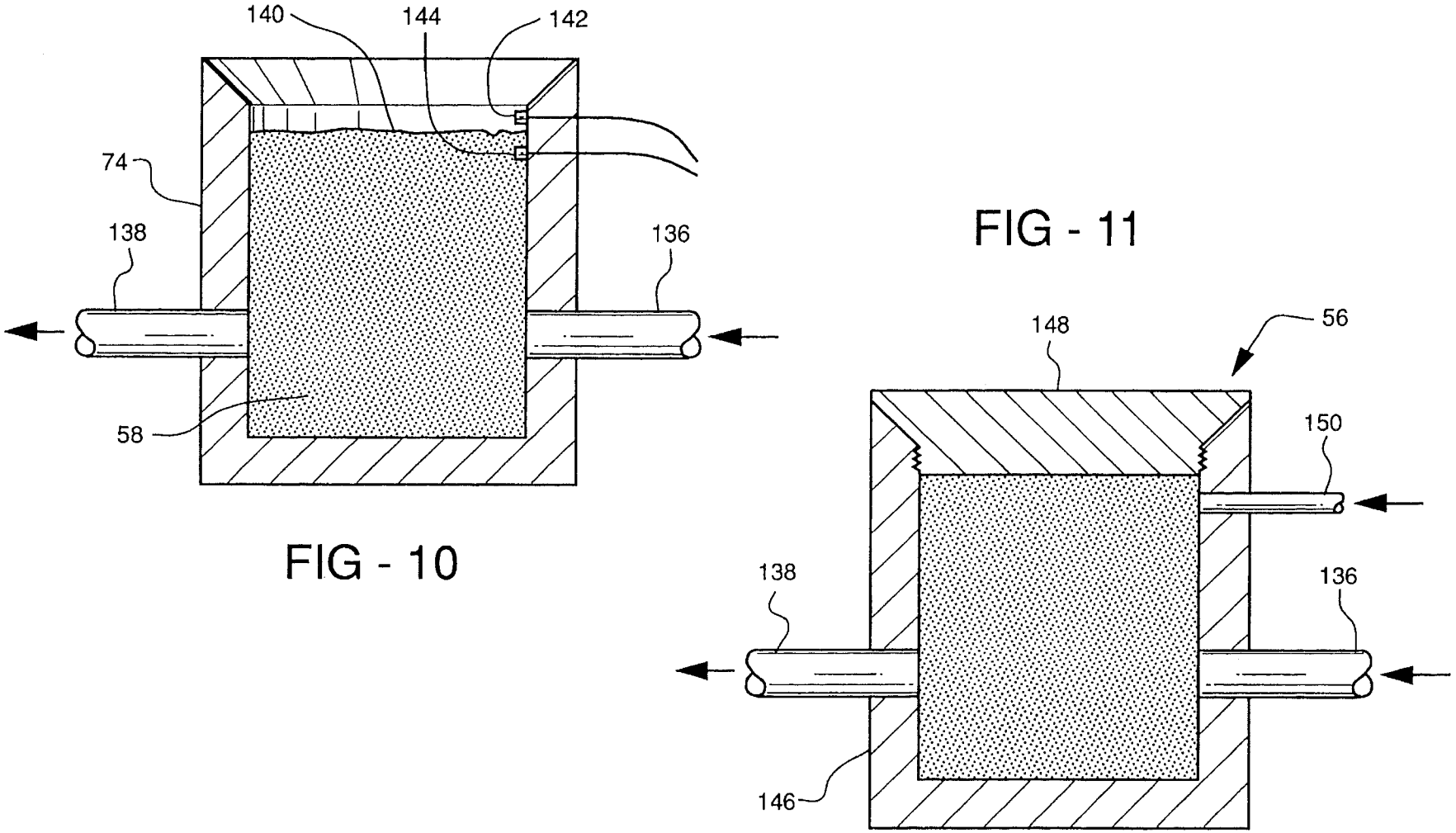
FIG. 10 is a cross-sectional view showing an exemplary form of open container in accordance with the invention.
FIG. 11 is a cross-sectional view showing an exemplary form of closed pressurized container in accordance with the invention.

FIG. 10 illustrates one possible form of the open topped treatment container 74 used in the embodiments of FIGS. 3 and 6 and, optionally, 7 and 9. The container 74 is formed as an open topped body having an inlet conduit 136 on one side and an outlet conduit 138 on the other side. The container 74 holds a treatment additive 58 and a body of fluid 140 having a level which may be controlled in a suitable system by upper and lower sensors 142, 144 respectively. These may be connected to the electronic control of any system to control the flow of fluid into and out of the tank in order to maintain a proper level.

FIG. 11 illustrates a form of closed pressurized treatment container 56 which might be used in the embodiments of FIGS. 1, 2, 4, 5 and 8. Container 56 includes an open topped body 146 an additive treatment substance 58 and having a sealing lid 148 closing the top thereof. An inlet conduit 136 and an outlet conduit 138 are provided as before. In addition, a smaller additive conduit 150 is provided in the side of the container through which fluidized chemical treatment materials 58 may be added to the tank for mixing with the processing solution which is fed to the tank through inlet 136 and leaves the tank after treatment through outlet 138.

The various embodiments of secondary loop additive systems described are exemplary only of the various ways in which the overall concept of a variable loop system may be applied to various forms of recirculating loop processing apparatus using recirculating solutions.

Although the invention has been described by reference to various specific embodiments, it should be understood that numerous changes may be made within the spirit and scope of the inventive concepts described. Accordingly, it is intended that the invention not be limited to the described embodiment, but that it have the full scope defined by the language of the following claims.

| Parts List |
|---|
| 20. processing apparatus |
| 21. prior apparatus |
| 22. processing tank |
| 24. outlet |
| 26. conduit |
| 28. recirculating pump |
| 30. conduit |
| 32. manifold |
| 34. conduit |
| 36. filter |
| 38. heat exchanger |
| 40. conduit |
| 42. electronic control |
| 44. bellows pumps |
| 46. overflow drain |
| 48. overflow reservoir |

-continued

| Parts List |
|---|
| 50. variable loop additive system |
| 52. conduit |
| 54. regulating valve |
| 55. conduit |
| 56. treatment container (closed) |
| 58. treatment substance (additive) |
| 59. conduit |
| 60. shutoff valve |
| 61. conduit |
| 62. second embodiment |
| 64. system |
| 66. conduit |
| 68. conduit |
| 69. conduit |
| 70. third embodiment |
| 72. system |
| 74. treatment container |
| 75. conduit |
| 76. conduit |
| 77. drain conduit |
| 78. fourth embodiment |
| 80. prior apparatus |
| 82. overflow sensor |
| 84. backflush valves |
| 86. filling pump |
| 88. additive system |
| 90. conduit |
| 92. conduit |
| 94. conduit |
| 96. metering pump |
| 97. conduit |
| 98. fifth embodiment |
| 99. conduit |
| 100. additive system |
| 101. conduit |
| 102. sixth embodiment |
| 104. additive system |
| 106. prior apparatus |
| 107. overflow drain |
| 108. conduit |
| 110. container |
| 112. metering vessel |
| 114. microprocessor |
| 116. motor |
| 117. pump |
| 118. tank |
| 120. seventh embodiment |
| 122. additive system |
| 123. conduit |
| 124. eighth embodiment |
| 125. additive system |
| 126. conduit |
| 127. conduit |
| 128. conduit |
| 129. conduit |
| 130. ninth embodiment |
| 132. additive system |
| 133. conduit |
| 134. conduit |
| 136. inlet conduit |
| 138. outlet conduit |
| 140. fluid |
| 142. sensor |
| 144. sensor |
| 146. body |
| 148. lid |
| 150. additive conduit |

What is claimed is:

1. An apparatus for processing photosensitive materials including a processing tank, a primary loop including the tank, a pump for recirculating a processing solution through the tank, and means for replenishing the processing solution in a predetermined manner, said apparatus characterized by:

a treatment container containing treatment substances for altering the condition of the processing solution;

a secondary loop including the container and having an inlet portion and an outlet portion, the inlet portion connecting an inlet of the treatment container with a first point of the primary loop for conducting processing solution for treatment to the treatment container and the outlet portion connecting with a second point of the primary loop for circulating treated processing solution back to the primary loop; and circulating means for circulating processing solution through the secondary loop for treatment in the treatment container;

said primary loop omitting any means for preventing flow in the normal direction of flow in the portion of said primary loop between said first and second points;

whereby, during operation, the circulation of processing fluid through the primary loop is continuous during the circulation of a portion of said processing solution for treatment through the secondary loop.

2. An apparatus as in claim 1 characterized by a flow control in the secondary loop for limiting the flow of processing solution through the treatment container.

3. An apparatus as in claim 2 characterized in that the flow control is a regulating valve.

4. An apparatus as in claim 2 characterized in that the flow control is a flow regulating pump.

5. An apparatus as in claim 1 characterized in that the treatment container is a closed pressure vessel.

6. An apparatus as in claim 1 characterized in that the treatment container is non-pressurized.

7. An apparatus as in claim 1 characterized in that the circulating means is a pressure difference between said first and second points of the primary loop to which the secondary loop is connected.

8. An apparatus as in claim 7 characterized in that said treatment container is closed and said secondary loop is connected between an outlet and inlet of said recirculating pump.

9. An apparatus as in claim 7 characterized in that said treatment container is closed and said secondary loop is connected between the processing container and the inlet of said recirculating pump.

10. An apparatus as in claim 6 characterized in that said treatment container is located to receive overflow solution from the processing tank.

11. An apparatus as in claim 10 characterized in that the treatment container has an outlet connected with an inlet of said recirculating pump.

12. An apparatus as in claim 1 characterized in that said circulating means is a pump located between the first and second points to which the secondary loop is connected.

13. An apparatus as in claim 12 characterized in that said treatment container is closed and said first and second points are both located in a pressurized portion of the primary loop.

14. An apparatus as in claim 12 characterized in that said treatment container is open and has an outlet connected to an inlet side of said recirculating pump.

15. A method for controlling the delivery of chemical additives to a photographic processing solution recirculating in a primary loop of a photographic processing apparatus, said method characterized by:

providing a secondary loop having inlet and outlet ends both connected with the primary loop;

providing a treatment container connected between the ends of the secondary loop;

delivering at least one chemical additive into the container;

circulating processing solution through the secondary loop from the primary loop for mixing with said additive; and regulating the flow of processing solution through the secondary loop to control the rate of mixing with the additive to a desired value.

* * * * *